US007628096B2

(12) United States Patent
Doucet

(10) Patent No.: US 7,628,096 B2
(45) Date of Patent: Dec. 8, 2009

(54) PEDAL MOUNT ASSEMBLY

(75) Inventor: William Doucet, Royersford, PA (US)

(73) Assignee: Teleflex Corporated, Limerick, PA (US)

( * ) Notice: Subject to any disclaimer, the term of this patent is extended or adjusted under 35 U.S.C. 154(b) by 653 days.

(21) Appl. No.: 11/006,433

(22) Filed: Dec. 6, 2004

(65) Prior Publication Data

US 2005/0211012 A1 Sep. 29, 2005

Related U.S. Application Data

(60) Provisional application No. 60/556,253, filed on Mar. 25, 2004.

(51) Int. Cl.
*G05G 1/30* (2008.04)

(52) U.S. Cl. ..... 74/560

(58) Field of Classification Search ..... 745/560; 74/512, 513, 560, 561
See application file for complete search history.

(56) References Cited

U.S. PATENT DOCUMENTS 1,214,866 A * 2/1917 Young ..... 74/513
1,428,082 A * 9/1922 Gammon ..... 74/513
2,521,606 A * 9/1950 Rodd ..... 74/513
3,059,960 A * 10/1962 Komorowski et al. ..... 296/64
3,630,326 A 12/1971 Kawaguchi
6,023,995 A 2/2000 Riggle
6,223,623 B1 * 5/2001 Vance ..... 74/513
6,364,047 B1 4/2002 Bortolon
6,862,950 B2 * 3/2005 O'Neill ..... 74/512
7,228,757 B2 * 6/2007 Peniston et al. ..... 74/512
2002/0157497 A1 10/2002 Porter et al.
2003/0094070 A1 5/2003 O'Neill
2003/0110879 A1 6/2003 Massey, III et al.
2004/0134305 A1 7/2004 Peniston et al.

* cited by examiner

*Primary Examiner*—Vicky A Johnson
(74) *Attorney, Agent, or Firm*—Baker & Hostetler LLP

(57) ABSTRACT

A pair of parallel ears (32) extend upwardly from a base (22) to pivotally support a pedal (20). A mounting plate (36) includes a mounting portion (42) for attachment to a vehicle and a raised tongue (44) extending from a raised tunnel portion (48) for receiving a projection (46) of the base (22). The raised tongue (44) is narrower than the pivot distance between the ears (32) for extending between the ears (32). A slot (40) is defined by the mounting plate (36) with a bolt extending through the slot (40) from the projection (46) of the base (22) for fixing the operational position. The structure allows the assembly to be mounted in a wide variety of vehicles and fixed in an operating position dependent upon the space in the vehicle and fixed in that operating position for all further vehicle operation.

11 Claims, 3 Drawing Sheets

PEDAL MOUNT ASSEMBLY

CROSS REFERENCE TO RELATED APPLICATION

This application claims the benefit of provisional application Ser. No. 60/556,253 filed Mar. 25, 2004.

BACKGROUND OF THE INVENTION

1. Field of the Invention

A mount assembly for a pedal of the type for controlling the throttle or brake of a vehicle.

2. Description of the Prior Art

A wide variety of pedal assemblies are known that include a pedal pivotally supported on a base, which is, in turn, connected to a mounting plate that is attached to a vehicle. Many such assemblies include a connection that allows adjustment of the pedal position to accommodate various different drivers. Such adjustment changes the position of the pedal relative to the vehicle after the assembly is mounted in the vehicle. Examples of such assemblies are disclosed in U.S. Pat. No. 3,630,326 to Kawaguchi; U.S. Pat. No. 6,023,995 to Riggle; U.S. Pat. No. 6,364,047 to Bortolon and U.S. Patent Publications No. 2002/0157497 to Porter et al.; No. 2003/0094070 to O'Neill; No. 2003/0110879 to Massey III et al.; and No. 2004/0134305 to Peniston et al.

However, these assemblies are especially adapted for adjustment during the life of operational use, i.e., the life of the vehicle in which installed. Normally, such assemblies are designed for installation in a predetermined vehicle to satisfy the packaging requirements of that particular vehicle. Consequently, a separate and distinct pedal assembly is designed for each vehicle without the pedal assembly being mountable in any other vehicle. Accordingly, a need exists for a pedal assembly that may be mounted in a wide variety of different vehicles and fixed in the mounted position for the life of operation. In other words, a pedal assembly that may be mounted in a wide variety of packaging requirements could be made in extensive volumes to reduce manufacturing costs by being used across a large range of vehicle models.

SUMMARY OF THE INVENTION AND ADVANTAGES

The invention provides for a sliding connection between the base and the mounting plate of a pedal assembly for sliding the base relative to the plate to an operational position for a predetermined vehicle and for fixing that operational position for that predetermined vehicle. The assembly may be installed in anyone of a variety of different models of vehicles.

Accordingly, the invention provides a novel structure that allows the pedal assembly to be mounted into numerous different vehicle models and adjusted to the operational position for that model and fixed in the operational position for the life of the vehicle. This assembly may be manufactured in larger volumes to thereby reduce costs because it is usable in a larger number of vehicles.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
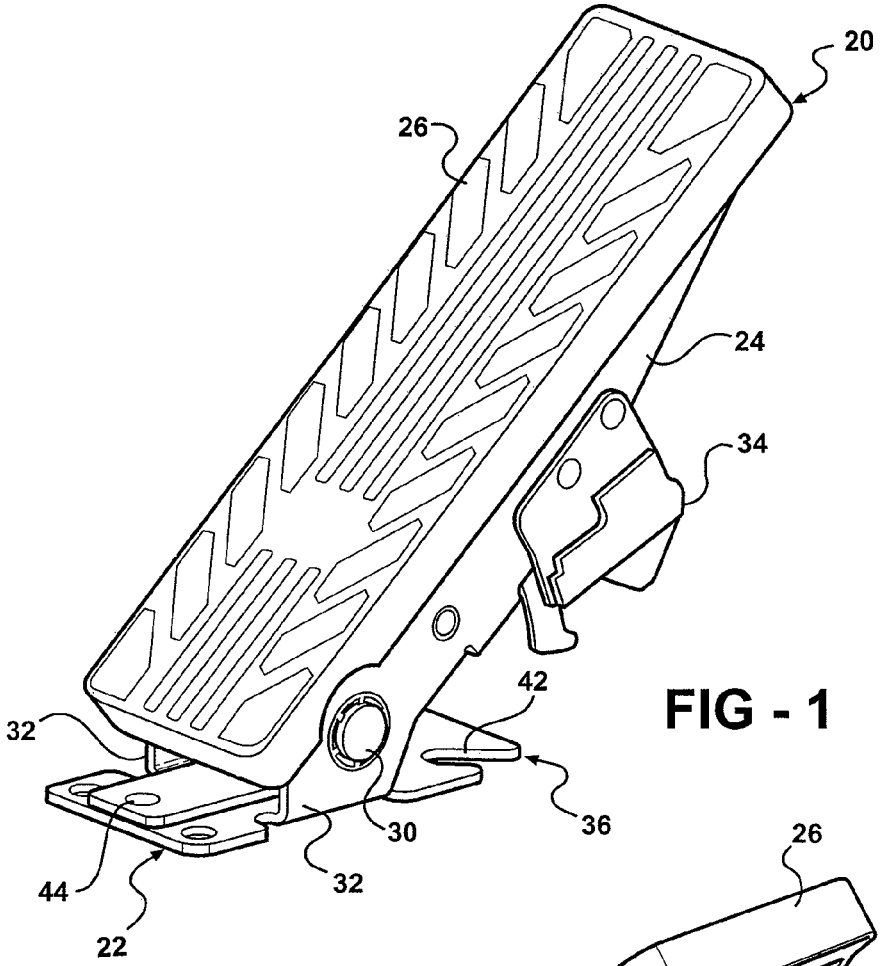
FIG. 1 is a perspective view of the assembly.

A pedal 20 mount assembly is shown in the drawings and includes a base, generally shown at 22, and a pedal, generally indicated at 20, and pivotally supported on the base 22. The pedal 20 includes a backing member 24 supporting a pad or tread 26 between downwardly extending flanges 28 that pivotally support the pedal 20 on a shaft 30 extending between the flanges 28 and a pair of parallel ears 32 extending upwardly from the base 22 and spaced a pivot distance apart whereby the pedal 20 is pivotally supported by the ears 32. An electronic control mechanism 34 senses the pivotal movement of the pedal 20 relative to the base 22 and sends an electronic signal to the vehicle computer for controlling the throttle or brakes of a vehicle, as is well known in the art.

The assembly includes a mounting plate, generally indicated at 36, for attachment to a vehicle and is characterized by a sliding connection between the base 22 and the plate 36 for sliding the base 22 relative to the plate 36 to an operational position for a predetermined vehicle and for fixing that operational position for the predetermined vehicle whereby the assembly may be installed in anyone of a variety of different vehicles. More specifically, the connection includes a fastener 38 extending through a slot 40 defined by one of the base 22 and the plate 36 for clamping the base 22 and the plate 36 together for fixing the operational position. In other words, the mounting plate 36 may be attached anyone of various vehicles or vehicle configurations and the base 22 adjusted relative to the mounting plate 36 to the operational position for that particular vehicle and clamped or fixed in that position for the life of the vehicle or pedal 20 assembly, i.e., the base 22 is not adjusted relative to the mounting plate 36 once installed in a particular vehicle.

Figure 2:
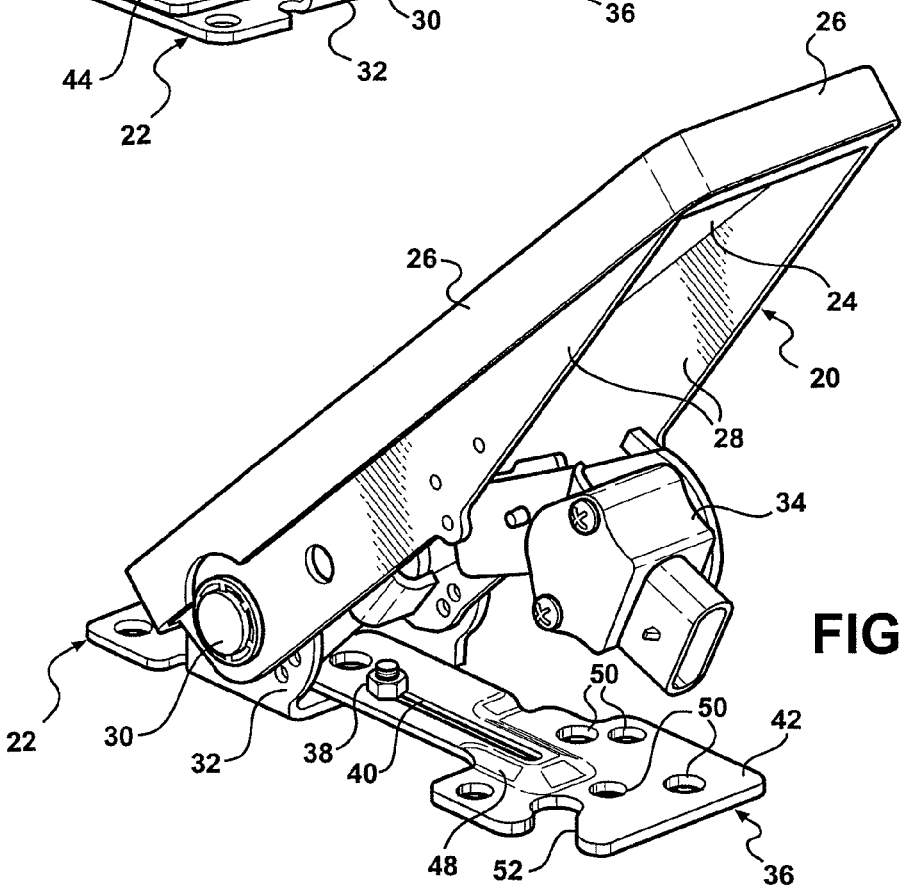
FIG. 2 is a perspective view of the assembly from the rear and at one extreme fixed operating position.
Figure 3:
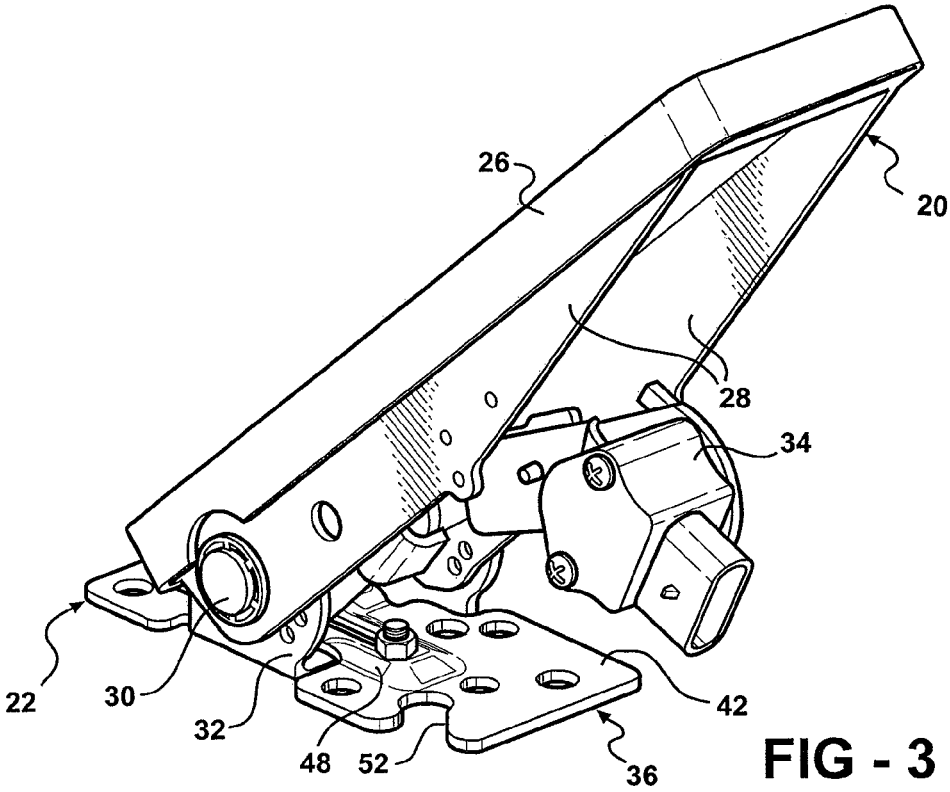
FIG. 3 is a perspective view of the assembly from the rear and at the opposite extreme fixed operating position.
Figure 4:
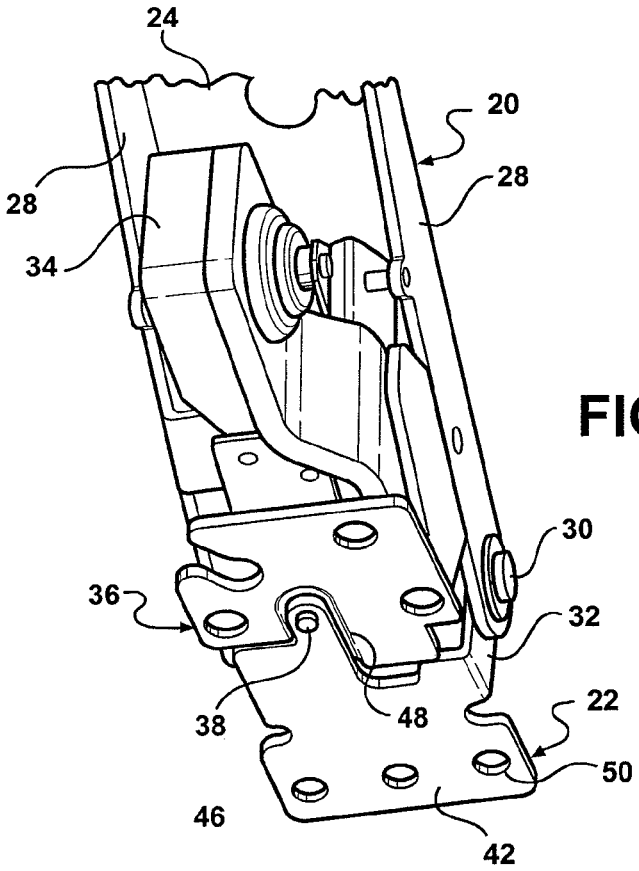
FIG. 4 is a perspective view from the underside of the assembly.

As best seen in FIGS. 2 and 4, the plate 36 includes a mounting portion 42 for attachment to the vehicle in a mounting plane and a tongue 44 extending from the mounting portion 42 in a guide plane spaced from the mounting plane for receiving the base 22 under the tongue 44 and between the planes. The slot 40 is disposed in the tongue 44 which is narrower than the pivot distance and is disposed to extend between the ears 32. As shown in FIG. 4, the base 22 includes a projection 46 more narrow than the pivot distance between the ears 32 with the fastener 38 being supported by the projection 46. In a complementary fashion, the mounting plate 36 includes a tunnel portion 48 raised from the mounting plane of the mounting portion 42 and aligned with the guide plane of the tongue 44 for receiving the projection 46. The fastener 38 comprises a bolt having its head secured to (as by welding) or disposed under the projection 46 and extends upwardly through the slot 40 and into threaded engagement with a nut.

The projection 46 is latterly offset for the centerline between the ears 32 and the mounting plate 36 includes holes 50 disposed in an uneven array along the sides and about the tunnel portion 48 for attaching the mounting plate 36 to a wide variety of vehicles. In addition to the holes 50, the mounting portion 42 defines an open recess 52 extending into its periphery for attaching the mounting plate 36 to the vehicle.

The embodiment of FIGS. 1-4 allows for mounting hardware directly under the treadle or pedal 20. The mounting plate 36 can be mounted to the floor of the vehicle with maximum tool clearance (the tool that torques down the fasters that hold down the pedal). Once the mounting plate 36 is fastened to the floor the rest of the pedal assembly can be slid into place, whereby a single fastener 38 holds the treadle against the mounting plate 36 and prevents the heal of the pedal from lifting up during normal operation. The ability to have mounting hardware directly under the "shadow" of the pedal 20 is important as it reduces the overall foot print of the pedal in newer vehicles having increasingly less mounting space.

Figure 5:
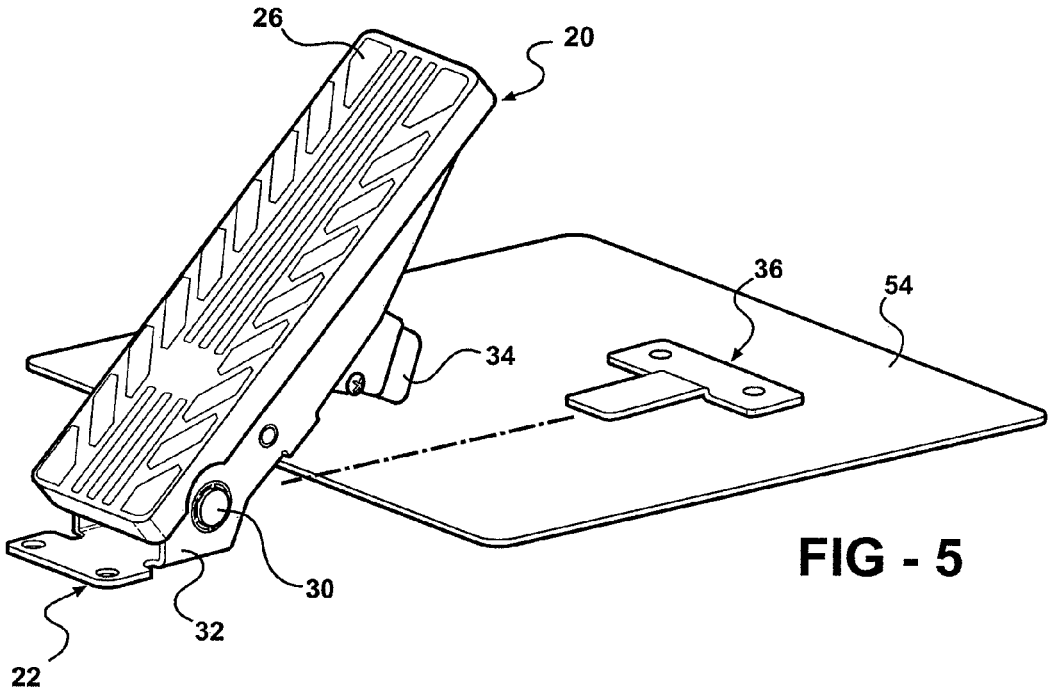
FIG. 5 is a perspective view of an embodiment wherein the mounting plate is an integral part of the vehicle floor prior to the base being connected.
Figure 6:
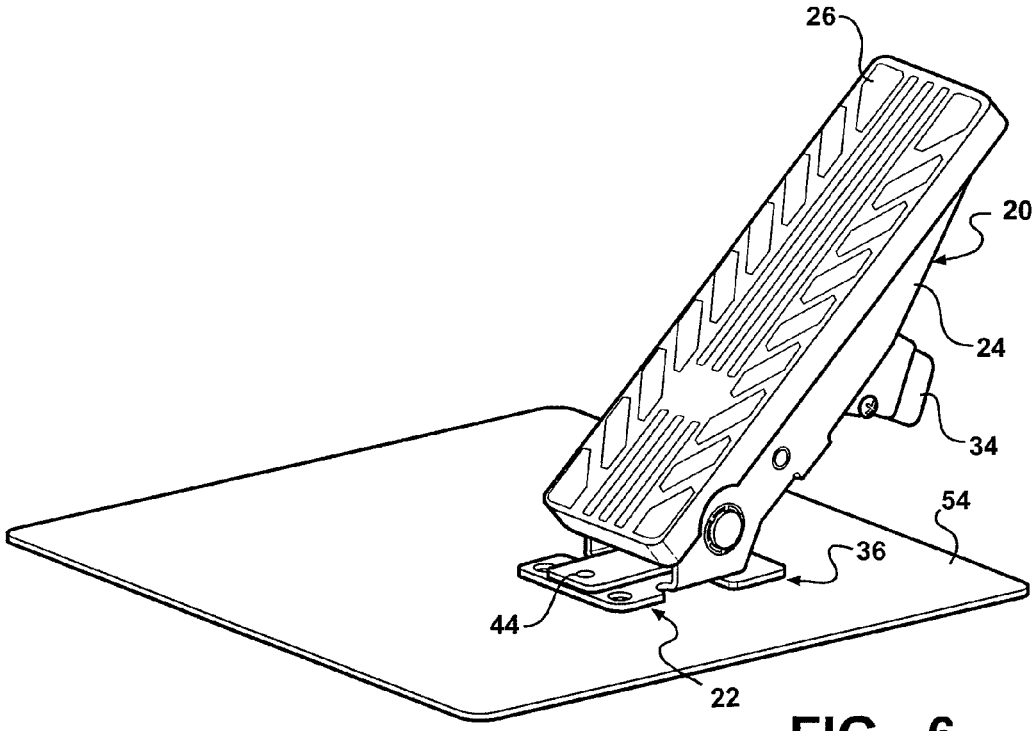
FIG. 6 is a perspective view like FIG. 5 but showing the base fixed in place by connection to the mounting plate.

As alluded above and as shown in FIGS. 5 and 6, the mounting portion 42 of the mounting plate 36 may be welded to or be integrally formed with the floor 54 of the vehicle for receiving the base 22. In other words, an important aspect of the invention is the tongue 44 extending from the mounting portion 42 in a guide plane spaced from the mounting plane for receiving the base 22 under the tongue 44 and between the planes. In order to conserve space within the vehicle, the tongue 44 is narrower than the pivot distance between the ears 32 so as to extend between the ears 32. in the complementary fashion, the projection 46 is narrower than the pivot distance between the ears 32 for extending under the tongue 44 and the raised tunnel portion 48.

The embodiment of FIGS. 5 and 6 reduces the number of bolts required for mounting. Since the plate 36 is integrated into the vehicle floor 54, the pedal 20 can be installed in the vehicle with just one bolt 38 at the heal of the pedal. This is advantageous because it reduces installation time into the vehicles by eliminating mounting hardware in front or under the toe of the pedal. Since it is very difficult to access tight quarters under the dashboard and between the transmission compartment (which is next to the driver right foot) and the brake pedal with power tools, this embodiment reduces the requirement for such access.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

ELEMENT LIST

| Element Symbol | Element Name |
|---|---|
| 20 | pedal |
| 22 | base |
| 24 | backing member |
| 26 | tread |
| 28 | flanges |

-continued

ELEMENT LIST

| Element Symbol | Element Name |
|---|---|
| 30 | shaft |
| 32 | ears |
| 34 | control mechanism |
| 36 | plate |
| 38 | fastener |
| 40 | slot |
| 42 | mounting portion |
| 44 | tongue |
| 46 | projection |
| 48 | tunnel portion |
| 50 | holes |
| 52 | recess |
| 54 | floor |

What is claimed is:

1. A mount assembly for a pedal comprising:

a base, a pedal pivotally supported on said base, a backing member that supports said pedal, wherein said backing member comprises opposing flanges extending therefrom, a mounting plate for attachment to a vehicle, wherein said mounting plate comprises a slot that extends along said mounting plate and characterized by a sliding connection between said base and said plate via said slot for sliding said base relative to said plate to an operational position for a predetermined vehicle and for fixing that operational position for the predetermined vehicle whereby said assembly may be installed in anyone of a variety of different vehicles, wherein said connection includes a fastener for clamping said base and said plate together in said operational position and said connection includes said slot defined by one of said base and said plate with said fastener extending through said slot for fixing said operational position; and wherein said plate includes a mounting portion for attachment to the vehicle in a mounting plane and a tongue extending from said mounting portion in a guide plane spaced from said mounting plane for receiving said base under said tongue and between said planes.

2. An assembly as set forth in claim 1 wherein said base includes a pair of parallel ears spaced a distance apart with said pedal pivotally being supported between said ears, said tongue being more narrow than said distance and disposed to extend between said ears.

3. An assembly as set forth in claim 2 further defined as said slot being disposed in said tongue.

4. An assembly as set forth in claim 3 wherein said base includes a projection more narrow than said distance, with said fastener being supported by said projection.

5. An assembly as set forth in claim 4 further defined as said projection being latterly offset for the centerline between said ears.

6. An assembly as set forth in claim 4 wherein said mounting plate includes a tunnel portion raised from said mounting plane and aligned with said guide plane and said tongue for receiving said projection.

7. An assembly as set forth in claim 6 wherein said mounting plate includes holes disposed about said tunnel portion for attaching said mounting plate to the vehicle.

8. An assembly as set forth in claim 6 wherein said mounting plate includes a periphery extending along opposite sides of said tunnel and outwardly therefrom.

9. An assembly as set forth in claim 8 wherein said mounting plate includes holes disposed along said sides and about said tunnel portion for attaching said mounting plate to the vehicle.

10. An assembly as set forth in claim 9 further defined as said holes being disposed in an uneven array about said tunnel portion.

11. An assembly as set forth in claim 8 wherein said mounting portion defines an open recess extending into the periphery thereof for attaching said mounting plate to the vehicle.

* * * * *